US008723405B2

(12) United States Patent
Kato

(10) Patent No.: US 8,723,405 B2
(45) Date of Patent: May 13, 2014

(54) SPARK PLUG AND METHOD FOR PRODUCING SPARK PLUG

(75) Inventor: Tomoaki Kato, Nagoya (JP)

(73) Assignee: NGK Spark Plug Co., Ltd, Nagoya (JP)

( * ) Notice: Subject to any disclaimer, the term of this patent is extended or adjusted under 35 U.S.C. 154(b) by 60 days.

(21) Appl. No.: 13/393,269

(22) PCT Filed: Sep. 9, 2010

(86) PCT No.: PCT/JP2010/065542
§ 371 (c)(1),
(2), (4) Date: Feb. 29, 2012

(87) PCT Pub. No.: WO2011/048882
PCT Pub. Date: Apr. 28, 2011

(65) Prior Publication Data

US 2012/0153801 A1 Jun. 21, 2012

(30) Foreign Application Priority Data

Oct. 23, 2009 (JP) ..... 2009-244216

(51) Int. Cl.
*H01T 13/12* (2006.01)
*H01T 21/02* (2006.01)

(52) U.S. Cl.
USPC ..... 313/141; 313/143

(58) Field of Classification Search
USPC ..... 313/118, 141–143; 445/7; 123/143, 123/169 R; 219/121.64
See application file for complete search history.

(56) References Cited

U.S. PATENT DOCUMENTS

| | | | | |
|---|---|---|---|---|
| 6,414,420 | B1 * | 7/2002 | Suzuki | 313/144 |
| 2001/0050522 | A1 * | 12/2001 | Nasu et al. | 313/118 |
| 2002/0041135 | A1 | 4/2002 | Fukushima | |
| 2006/0022566 | A1 | 2/2006 | Ishiguro | |
| 2008/0093964 | A1 | 4/2008 | Kawashima | |

FOREIGN PATENT DOCUMENTS

| | | | |
|---|---|---|---|
| CN | 1086162 | A | 5/1994 |
| JP | 11-345676 | A | 12/1999 |
| JP | 2006-66385 | | 3/2006 |
| JP | 2006-236906 | | 9/2006 |
| JP | 2007-141868 | | 6/2007 |
| JP | 2008-123989 | | 5/2008 |

OTHER PUBLICATIONS

International Search Report mailed Dec. 14, 2010 for the corresponding PCT Application No. PCT/JP2010/065542.
Office Action mailed Jul. 15, 2013 for the corresponding Chinese Patent Application No. 201080047756.1.

* cited by examiner

*Primary Examiner* — Anh Mai
*Assistant Examiner* — Elmito Breval
(74) *Attorney, Agent, or Firm* — Leason Ellis LLP

(57) ABSTRACT

A spark plug includes a tubular metallic shell extending in the direction of an axis and having a tool engagement portion formed through extrusion. The tool engagement portion has a 12-point shape which is a sectional shape taken orthogonally to the axis and has a plurality of protrusions and recesses provided alternately. As viewed in a section taken orthogonally to the axis, when D (mm) represents the diameter of a circle which passes radially through the outermost positions on the protrusions, and d (mm) represents the diameter of a circle which passes radially through the innermost positions on the recesses, the relational expression $0.45 \leq (D-d)/2 \leq 0.75$ is satisfied. The spark plug can provide a more reliable restraint on the slippage of a tool at the time of mounting and enables the tool engagement portion to be reliably formed so as to form a desired shape.

18 Claims, 10 Drawing Sheets

SPARK PLUG AND METHOD FOR PRODUCING SPARK PLUG

CROSS-REFERENCE TO RELATED PATENT APPLICATIONS

This application is a U.S. National Phase Application under 35 U.S.C. §371 of International Patent Application No. PCT/JP2010/065542, filed Sep. 9, 2010, and claims the benefit of Japanese Patent Application No. 2009-244216, filed Oct. 23, 2009, all of which are incorporated by reference herein. The International Application was published in Japanese on Apr. 28, 2011 as International Publication No. WO/2011/048882 under PCT Article 21(2).

FIELD OF THE INVENTION

The present invention relates to a spark plug for use in an internal combustion engine, etc., and to a method for producing the spark plug.

BACKGROUND OF THE INVENTION

A spark plug is mounted to, for example, a combustion apparatus, such as an internal combustion engine, for igniting an air-fuel mixture contained in a combustion chamber. Generally, a spark plug includes an insulator having an axial bore; a center electrode inserted into a front end portion of the axial bore; a metallic shell provided externally of the outer circumference of the insulator; and a ground electrode provided at a front end portion of the metallic shell and forming a spark discharge gap in cooperation with the center electrode. Also, the metallic shell has a tool engagement portion for allowing a tool to be engaged therewith when the spark plug is to be mounted to the combustion apparatus.

A generally known tool engagement portion has a hexagonal cross section. However, in recent years, there is proposed a tool engagement portion having a 12-point shape (also called a "Bi-Hex shape"), in which a plurality of protrusions (ridges) and recesses (grooves) are provided alternately along its outer circumference (refer to, for example, Japanese Patent Application Laid-Open (kokai) No. 2006-66385). As compared with a tool engagement portion having a hexagonal cross section, the tool engagement portion having a 12-point shape has the following merits.

In association with a recent demand for a reduction in the size of a spark plug, the diameter of the metallic shell is reduced. In view of retainment of strength or the like, the tool engagement portion must have a wall thickness of a certain minimum size. Thus, when the tool engagement portion has a hexagonal cross section, the inside diameter of the metallic shell must be sufficiently reduced. However, in association with a reduction in the inside diameter of the metallic shell, an insulator to be inserted into the metallic shell must be reduced in diameter. As a result, the insulator may deteriorate in dielectric strength and mechanical strength. By contrast, by means of the tool engagement portion having a 12-point shape, the metallic shell can be reduced in diameter without need to excessively reduce the inside diameter of the metallic shell, so that the tool engagement portion can retain a sufficient wall thickness. That is, by means of the tool engagement portion having a 12-point shape, while the spark plug is reduced in size, deterioration in dielectric strength and mechanical strength of the insulator can be effectively prevented.

SUMMARY OF THE INVENTION

Problems to be Solved by the Invention

In view of production efficiency, etc., generally, cold forging (extrusion) is used to form a metallic shell having a tool engagement portion. However, since a 12-point shape is a relatively complex shape, difficulty is encountered in accurately imparting a desired shape to the tool engagement portion. As compared with the tool engagement portion having a hexagonal cross section, the tool engagement portion having the 12-point shape has a cross section whose outline more closely approximates a circle. Therefore, when the spark plug is to be mounted to a combustion apparatus, a tool is apt to slip on the tool engagement portion, potentially resulting in interruption to mounting of the spark plug.

The present invention has been conceived in view of the above circumstances, and an object of the invention is to provide a spark plug whose tool engagement portion has a 12-point shape and can be more reliably formed so as to assume a desired shape and which provides more reliable restraint of slippage of a tool at the time of mounting, as well as a method for producing the spark plug.

Means for Solving the Problems

Configurations suitable for achieving the above object will next be described in itemized form. If needed, actions and effects peculiar to the configurations will be described additionally.

Configuration 1: A spark plug of the present configuration comprises a tubular metallic shell having a tool engagement portion formed through extrusion. The tool engagement portion has a 12-point shape which is a sectional shape taken orthogonally to an axis and has a plurality of protrusions and recesses provided alternately. The spark plug is characterized in that: as viewed on a section of the metallic shell taken orthogonally to the axis, when D (mm) represents a diameter of a circle which passes radially outermost positions on the protrusions, and d (mm) represents a diameter of a circle which passes radially innermost positions on the recesses, a relational expression $0.45 \leq (D-d)/2 \leq 0.75$ is satisfied.

The "12-point shape" is formed by coaxially overlaying two substantially equilateral hexagons of the same size on each other and then rotating one of the substantially equilateral hexagons by 30 degrees about the axis. As mentioned above, the 12-point shape is also referred to as a Bi-Hex shape.

According to the above configuration 1, the tool engagement portion is formed in such a manner that, when D (mm) represents the diameter of a circle (hereinafter, may be referred to as a "circumscribed circle of the tool engagement portion") which passes radially outermost positions on the protrusions of the tool engagement portion, and d (mm) represents the diameter of a circle (may be referred to as an "inscribed circle of the tool engagement portion") which passes radially innermost positions on the recesses, the relational expression $0.45 \leq (D-d)/2 \leq 0.75$ is satisfied. That is, through employment of a sufficiently large value of $(D-d)/2$ of 0.45 mm or greater, a relatively large difference in diameter is established between the circumscribed circle and the inscribed circle of the tool engagement portion, whereby sufficient strength of engagement of a tool with the tool engagement portion can be ensured. As a result, when the spark plug is to be mounted, slippage of the tool on the tool engagement portion can be more reliably prevented.

Generally, the tool engagement portion is formed as follows: a tubular die having an inner circumferential shape corresponding to the tool engagement portion is disposed externally of the outer circumference of a predetermined metal material (which will become the metallic shell), and then the metal material is subjected to extrusion, thereby bringing an outer circumferential portion of the metal material into pressing contact with an inner circumferential portion of the die. According to the present configuration 1, (D−d)/2 is 0.75 mm or less, whereby, in the course of extrusion, the metal material can reliably reach deep into recesses of the die corresponding to the protrusions of the tool engagement portion. As a result, the tool engagement portion can be more reliably formed in a desired shape.

Furthermore, the employment of a value of (D−d)/2 of 0.75 mm or less can prevent the angle of the recesses of the die from becoming excessively small (steep), whereby, in the course of extrusion, application of an excessive stress to the die from the metal material can be more reliably prevented. As a result, the service life of the die can be elongated, and productivity can be further improved.

Configuration 2: A spark plug of the present configuration is characterized in that, in the above configuration 1, the metallic shell has a large-diameter portion greater in diameter than the tool engagement portion, and, when A (mm) represents an outside diameter of the large-diameter portion, a relational expression $0.60 \leq (A-D)/2 \leq 1.00$ is satisfied.

Generally, the metallic shell has the large-diameter portion greater in diameter than the tool engagement portion, and a relatively thin-walled groove portion located between the tool engagement portion and the large-diameter portion. When crimping is performed for fixing the metallic shell and the insulator together, the groove portion is contractively deformed along the axial direction, whereby the metallic shell applies an axial force to the insulator, and thus the metallic shell and the insulator are more strongly fixed together.

Also, generally, the metallic shell is produced as follows: a predetermined metal material is subjected to extrusion along the axial direction, thereby assuming a general shape; then, machining or the like is performed so as to adjust the outline. More specifically, a die having an inner circumferential shape corresponding to the tool engagement portion and the large-diameter portion is disposed externally of the outer circumference of the metal material. Then, the metal material is subjected to extrusion along the axial direction so as to bring an outer circumferential portion of the metal material into pressing contact with an inner circumferential portion of the die, thereby forming a polygonal columnar portion having the same sectional shape as that of the tool engagement portion, and a circular columnar portion connected to the front end of the polygonal columnar portion and having the same sectional shape as that of the large-diameter portion. Then, machining or the like is performed on a front end portion of the polygonal columnar portion, thereby forming the groove portion. Furthermore, various types of working are performed, thereby yielding the metallic shell having the tool engagement portion and the large-diameter portion.

In this manner, a metallic-shell intermediate is formed in such a condition that a portion (a polygonal columnar portion) corresponding to the tool engagement portion and a portion (a circular columnar portion) corresponding to the large-diameter portion are connected to each other. The inventors of the present invention carried out extensive studies on the difference between the diameter of the circumscribed circle of the polygonal columnar portion (the tool engagement portion) and the outside diameter of the circular columnar portion (the large-diameter portion) and found that a certain diameter differential therebetween may cause a failure to impart desired shapes to the tool engagement portion and the large-diameter portion. Specifically, in the case of a large diameter differential, in the course of extrusion, more material must be moved toward a portion of the die corresponding to the circular columnar portion; as a result, material is less likely to move to a portion of the die adapted to form the polygonal columnar portion (the tool engagement portion). Thus, material for forming the polygonal columnar portion (particularly, the protrusions) may become insufficient, potentially resulting in a failure to impart a desired shape to the tool engagement portion (particularly, the protrusions). On the other hand, in the case of a small diameter differential, after extrusion, the outline of the polygonal columnar portion (the tool engagement portion) is apt to emerge into the outline of the circular columnar portion (the large-diameter portion). Thus, the formed circular columnar portion (the large-diameter portion) may fail to have a desired shape (a cylindrical shape).

In this connection, according to the above configuration 2, when A (mm) represents the outside diameter of the large-diameter portion of the metallic shell, and D (mm) represents the diameter of the circumscribed circle of the tool engagement portion, the diameter differential therebetween is determined so as to satisfy the relational expression $0.60 \leq (A-D)/2 \leq 1.00$. Thus, a shortage of material in the protrusions of the tool engagement portion and a deformation of the large-diameter portion can be more reliably prevented, so that the tool engagement portion and the large-diameter portion can be more reliably formed in respectively desired shapes.

Configuration 3: A spark plug of the present configuration is characterized in that, in the above configuration 1 or 2, when the metallic shell has an inside diameter B (mm) as measured at a position corresponding to the tool engagement portion, a relational expression $1.30 \leq (d-B)/2 \leq 1.40$ is satisfied.

According to the above configuration 3, when B (mm) represents the inside diameter of the metallic shell as measured at a position corresponding to the tool engagement portion, and d (mm) represents the diameter of the inscribed circle of the tool engagement portion, the diameter differential therebetween is determined so as to satisfy the relational expression $1.30 \leq (d-B)/2 \leq 1.40$. That is, through employment of a value of (d−B)/2 of 1.30 mm or greater, the tool engagement portion can have a sufficient wall thickness. Thus, when a large load is imposed on the tool engagement portion; for example, in a crimping process in which a portion (the crimp portion) located rearward of the tool engagement portion is bent radially inward so as to fix the insulator and the metallic shell together, the occurrence of cracking in or a deformation of the tool engagement portion can be more reliably prevented.

Furthermore, the employment of a value of (d−B)/2 of 1.40 mm or less can more reliably prevent dimensional variation of the tool engagement portion and the large-diameter portion among products. As a result, productivity can be further improved.

Configuration 4: A spark plug of the present configuration is characterized in that: in any one of the above configurations 1 to 3, the spark plug further comprises an insulator fixed internally of an inner circumference of the metallic shell; the metallic shell has a crimp portion extending rearward from a rear end of the tool engagement portion and engaged directly or indirectly with the insulator for fixing the insulator; and when B (mm) represents an inside diameter of the metallic shell as measured at a position corresponding to the tool engagement portion, and C (mm) represents an outside diameter of a proximal end of the crimp portion, a relational expression $0.70 \leq (C-B)/2 \leq 1.00$ is satisfied.

According to the above configuration 4, when B (mm) represents the inside diameter of the metallic shell as measured at a position corresponding to the tool engagement portion, and C (mm) represents the outside diameter of the proximal end of the crimp portion, the diameters B and C are determined so as to satisfy the relational expression $0.70 \leq (C-B)/2 \leq 1.00$. That is, through employment of a value of $(C-B)/2$ of 0.70 mm or greater, the crimp portion can have a sufficient wall thickness. Thus, an axial force which the crimp portion applies to the insulator can be further increased, thereby further improving fixation between the metallic shell and the insulator. Also, there can be effectively prevented a reverse deformation of the crimp portion which could otherwise result from impact associated with operation of a combustion apparatus, or the like. This also contributes to improvement in fixation between the metallic shell and the insulator.

On the other hand, the value of $(C-B)/2$ is specified as 1.00 mm or less, thereby preventing the crimp portion from becoming excessively thick. This can more reliably prevent a situation in which, in the course of crimping, the tool engagement portion is also deformed in association with deformation of the crimp portion.

Configuration 5: A spark plug of the present configuration is characterized in that, in any one of the above configurations 1 to 4, a relational expression $0.45 \leq (D-d)/2 \leq 0.65$ is satisfied.

According to the above configuration 5, the tool engagement portion is formed in such a manner that the relational expression $(D-d)/2 \leq 0.65$ is satisfied, where D (mm) is the diameter of the circumscribed circle of the tool engagement portion, and d (mm) is the diameter of the inscribed circle of the tool engagement portion. Thus, the tool engagement portion can be more reliably formed in a predetermined shape, and damage to the die can be more reliably prevented, whereby workability can be further improved.

Configuration 6: A spark plug of the present configuration is characterized in that, in any one of the above configurations 1 to 5, the metallic shell has a groove portion located between the tool engagement portion and the large-diameter portion, and, when H (mm) represents a length of the groove portion along the axis, and T (mm) represents a thickness of the groove portion, relational expressions $T \geq 0.7$ and $3.0 \leq H/T \leq 5.5$ are satisfied.

In the course of crimping, the groove portion located between the tool engagement portion and the large-diameter portion contracts along the axial direction and is radially deformed in a curving manner. When the amount of radial deformation of the groove portion is excessively large, the outside diameter of the groove portion may become larger than the diameter of the inscribed circle of the recesses of the tool engagement portion, potentially resulting in a failure to properly engage a tool with the tool engagement portion. Thus, in order to reduce the amount of radial deformation of the groove portion, reducing the length of the groove portion is conceived. However, when the length of the groove portion is reduced excessively relative to the thickness of the groove portion, in the course of crimping, the groove portion is hardly deformed radially. As a result, stress which is axially applied to the tool engagement portion from the groove portion increases, potentially resulting in a deformation of the tool engagement portion.

In this connection, according to the above configuration 6, the groove portion has a sufficient thickness T of 0.7 mm or greater; thus, in the course of crimping, the amount of radial deformation of the groove portion can be relatively small. Furthermore, since the relational expression $3.0 \leq H/T$ is satisfied; i.e., the length of the groove portion is large to some extent relative to the thickness of the groove portion, in the course of crimping, there can be effectively restrained axial application of an excessively large stress to the tool engagement portion from the groove portion. As a result, an excessive increase in the outside diameter of the groove portion and a deformation of the tool engagement portion can be more reliably prevented, so that a tool can be engaged properly with the tool engagement portion in a more reliable manner.

In view of prevention of a deformation of the tool engagement portion, it is effective that the length of the groove portion is large to some extent relative to the thickness of the groove portion. However, when the length of the groove portion is excessively large relative to the thickness of the groove portion, an axial force which the metallic shell applies to the insulator drops, potentially resulting in breakage of gastightness between the metallic shell and the insulator.

In view of the above point, according to the above configuration 6, the length H of the groove portion is determined so as to satisfy the relational expression $H/T \leq 5.5$. Thus, coupled with the thickness T being 0.7 mm or greater, an axial force which the metallic shell applies to the insulator can be sufficiently large. As a result, deterioration in gastightness can be more reliably prevented.

Configuration 7: A method for producing a spark plug of the present configuration is a method for producing a spark plug according to any one of the above configurations 1 to 6. The metallic shell has a large-diameter portion greater in diameter than the tool engagement portion and located frontward of the tool engagement portion, and a groove portion located between the tool engagement portion and the large-diameter portion. The method is characterized in that the tool engagement portion, the large-diameter portion, and the groove portion are formed by forming, through the extrusion, a polygonal columnar portion having the same sectional shape as that of the tool engagement portion, and a circular columnar portion connected to a front end of the polygonal columnar portion and having the same sectional shape as that of the large-diameter portion, and then machining a front end portion of the polygonal columnar portion.

Technical ideas of the above configurations may be embodied in a method for producing a spark plug as in the case of the above configuration 7. In this case, actions and effects similar to those yielded by the above configuration 1, etc., are yielded.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

Figure 1:
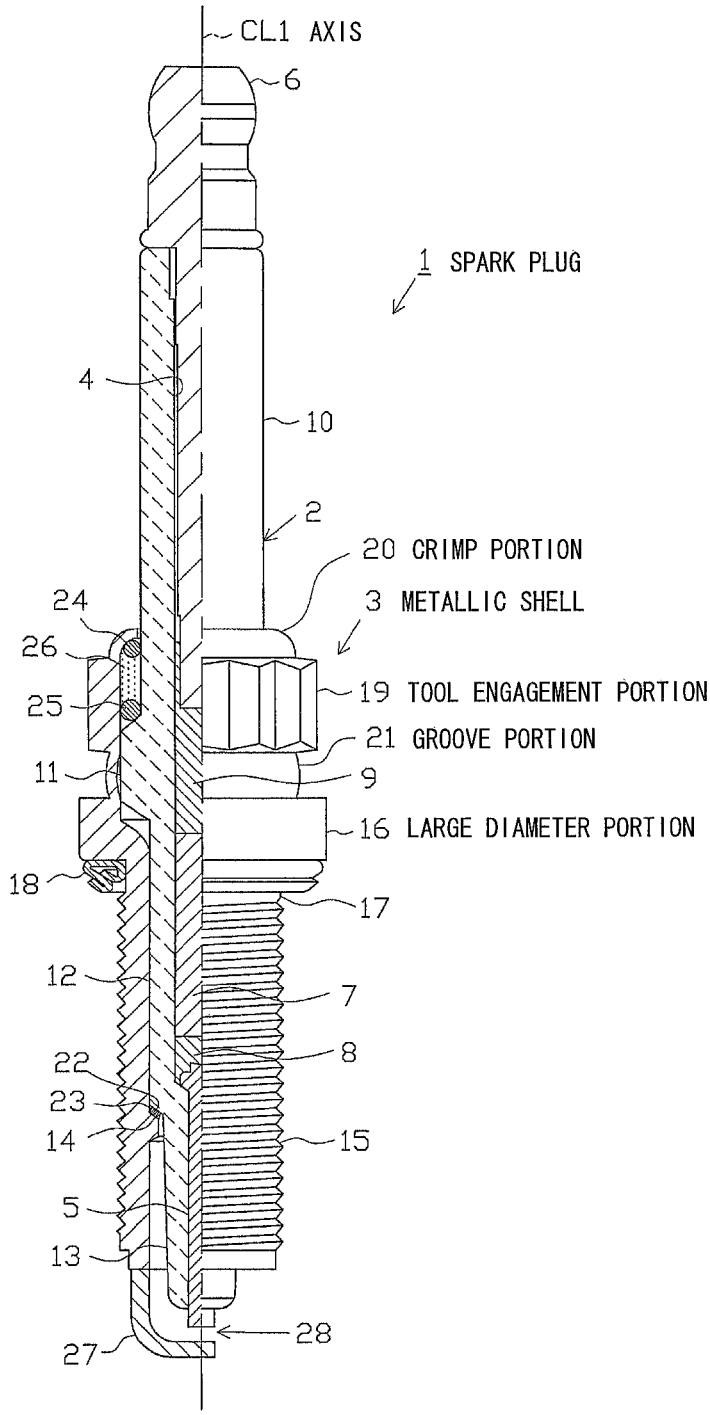
FIG. 1 is a partially cutaway front view showing the configuration of a spark plug.

An embodiment of the present invention will next be described with reference to the drawings. FIG. 1 is a partially cutaway front view showing a spark plug 1. In FIG. 1, the direction of an axis CL1 of the spark plug 1 is referred to as the vertical direction. In the following description, the lower side of the spark plug 1 in FIG. 1 is referred to as the front side of the spark plug 1, and the upper side as the rear side.

The spark plug 1 includes a tubular ceramic insulator (insulator) 2 and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed on the rear side; a flange portion 11, which is located frontward of the rear trunk portion 10 and projects radially outward; an intermediate trunk portion 12, which is located frontward of the flange portion 11 and is smaller in diameter than the flange portion 11; and a leg portion 13, which is located frontward of the intermediate trunk portion 12 and is smaller in diameter than the intermediate trunk portion 12. Additionally, the flange portion 11, the intermediate trunk portion 12, and most of the leg portion 13 of the ceramic insulator 2 are accommodated within the metallic shell 3. A tapered, stepped portion 14 is formed at a connection portion between the intermediate trunk portion 12 and the leg portion 13. The ceramic insulator 2 is seated on the metallic shell 3 at the stepped portion 14.

Furthermore, the ceramic insulator 2 has an axial bore 4 extending therethrough along the axis CL1. A center electrode 5 formed from an Ni alloy is fixedly inserted into a front end portion of the axial bore 4. The center electrode 5 assumes a rodlike (circular columnar) shape as a whole, and a front end portion of the center electrode 5 projects from the front end of the ceramic insulator 2.

Also, a terminal electrode 6 is fixedly inserted into the rear side of the axial bore 4 in such a manner as to project from the rear end of the ceramic insulator 2.

Furthermore, a circular columnar resistor 7 is disposed within the axial bore 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed in a tubular shape from a low-carbon steel or a like metal. The metallic shell 3 has, on its outer circumferential surface, a threaded portion (externally threaded portion) 15 adapted to mount the spark plug 1 to a combustion apparatus, such as an internal combustion engine or a fuel cell reformer. Also, the metallic shell 3 has, on its outer circumferential surface, a large diameter portion 16 expanding radially outward and located rearward of the threaded portion 15. A ring-like gasket 18 is fitted to a screw neck 17 at the rear end of the threaded portion 15. Furthermore, the metallic shell 3 has, near the rear end thereof, a tool engagement portion 19 (the shape, etc., of the tool engagement portion 19 will be described in detail later) allowing a tool, such as a wrench, to be engaged therewith when the metallic shell 3 is to be mounted to the combustion apparatus. Also, the metallic shell 3 has a crimp portion 20 located rearward of the tool engagement portion 19 for retaining the ceramic insulator 2. Additionally, the metallic shell 3 has a groove portion 21 between the large-diameter portion 16 and the tool engagement portion 19. The groove portion 21 is relatively thin-walled and is curved radially outward at its central subportion.

Also, the metallic shell 3 has, on its inner circumferential surface, a tapered, stepped portion 22 adapted to allow the ceramic insulator 2 to be seated thereon. The ceramic insulator 2 is inserted frontward into the metallic shell 3 from the rear end of the metallic shell 3. In a state in which the stepped portion 14 of the ceramic insulator 2 butts against the stepped portion 22 of the metallic shell 3, a rear-end opening portion of the metallic shell 3 is crimped radially inward; i.e., the crimp portion 20 is formed, whereby the ceramic insulator 2 is fixed in place. An annular sheet packing 23 intervenes between the stepped portions 14 and 22 of the ceramic insulator 2 and the metallic shell 3, respectively. This retains gastightness of a combustion chamber and prevents outward leakage of fuel gas in a space between the inner circumferential surface of the metallic shell 3 and the leg portion 13 of the ceramic insulator 2, the leg portion 13 being exposed to the combustion chamber.

Furthermore, in order to ensure gastightness which is established by crimping, annular ring members 24 and 25 intervene between the metallic shell 3 and the ceramic insulator 2 in a region near the rear end of the metallic shell 3, and a space between the ring members 24 and 25 is filled with a powder of talc 26. That is, the metallic shell 3 holds the ceramic insulator 2 via the sheet packing 23, the ring members 24 and 25, and the talc 26.

A ground electrode 27 is joined to a front end portion of the metallic shell 3. The ground electrode 27 is formed from an Ni alloy, and an intermediate portion thereof is bent such that a distal end portion thereof faces a front end portion of the center electrode 5. A spark discharge gap 28 is formed between the distal end portion of the ground electrode 27 and the front end portion of the center electrode 5. Spark discharge is performed across the spark discharge gap 28 substantially along the axis CL1.

Figure 2:
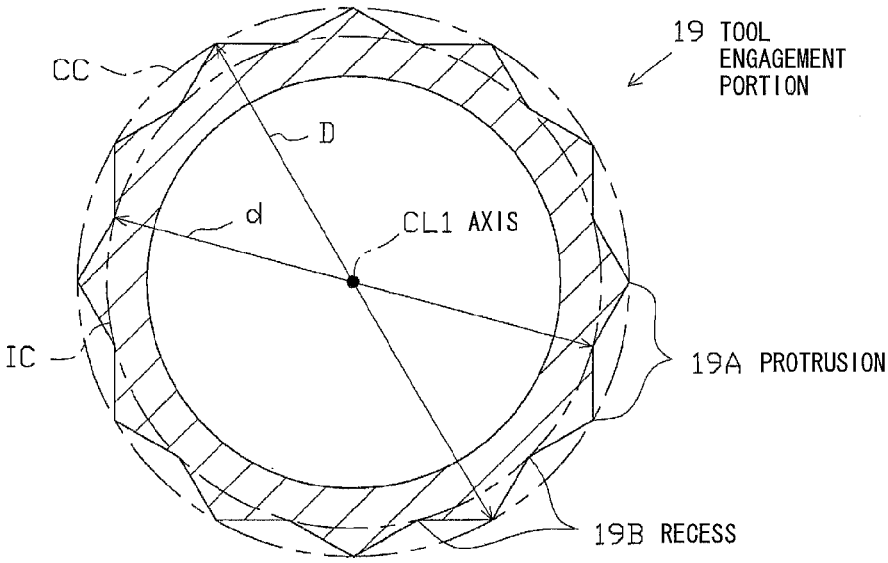
FIG. 2 is a cross-sectional view showing the configuration of a tool engagement portion.

Additionally, in the present embodiment, as shown in FIG. 2, the tool engagement portion 19 has, as viewed on a section orthogonal to the axis CL1, a 12-point shape which has a plurality of protrusions 19A and recesses 19B provided alternately. Furthermore, the tool engagement portion 19 is configured, as viewed on the section orthogonal to the axis CL1, such that, when D (mm) represents the diameter of a circle (a circumscribed circle) CC which passes radially outermost positions on the protrusions 19A, and d (mm) represents the diameter of a circle (an inscribed circle) IC which passes radially innermost positions on the recesses 19B, the relational expression $0.45 \leq (D-d)/2 \leq 0.75$ [preferably, $0.45 \leq (D-d)/2 \leq 0.65$] is satisfied. In the present embodiment, the diameter D of the circumscribed circle of the tool engagement portion 19 is smaller than the outside diameter of the large-diameter portion 16 of the metallic shell 3.

Figure 3:
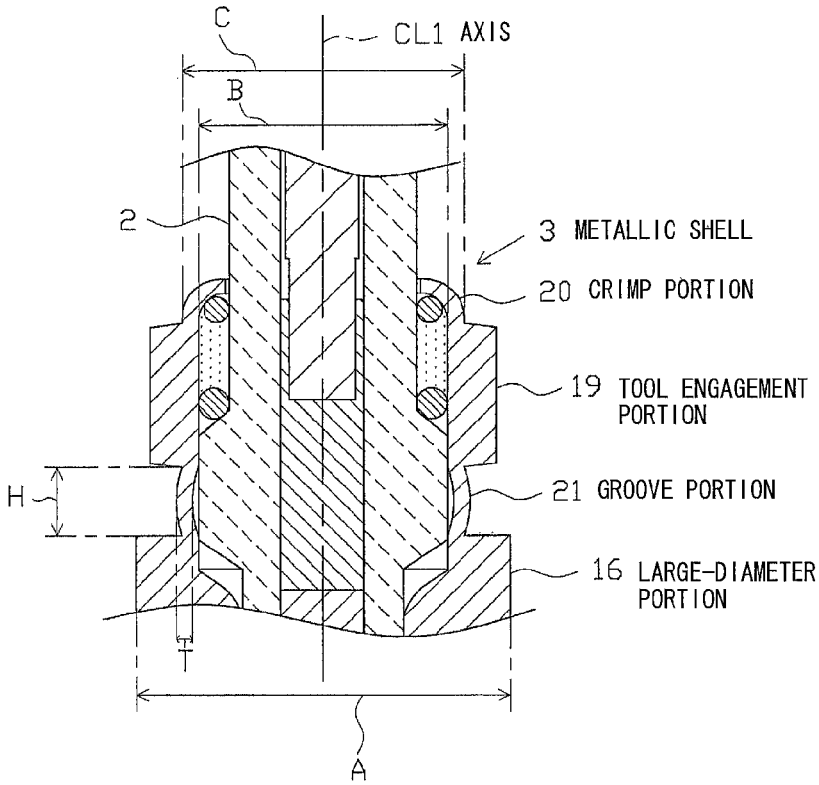
FIG. 3 is an enlarged sectional view showing the configuration of a rear end portion of a metallic shell.

Additionally, as shown in FIG. 3, the metallic shell 3 is formed such that, when A (mm) represents the outside diameter of the large-diameter portion 16 of the metallic shell 3, and B (mm) represents the inside diameter of the metallic shell 3 as measured at a position corresponding to the tool engagement portion 19, the relational expressions $0.60 \leq (A-D)/2 \leq 1.00$ and $1.30 \leq (d-B)/2 \leq 1.40$ are satisfied.

Figure 4:
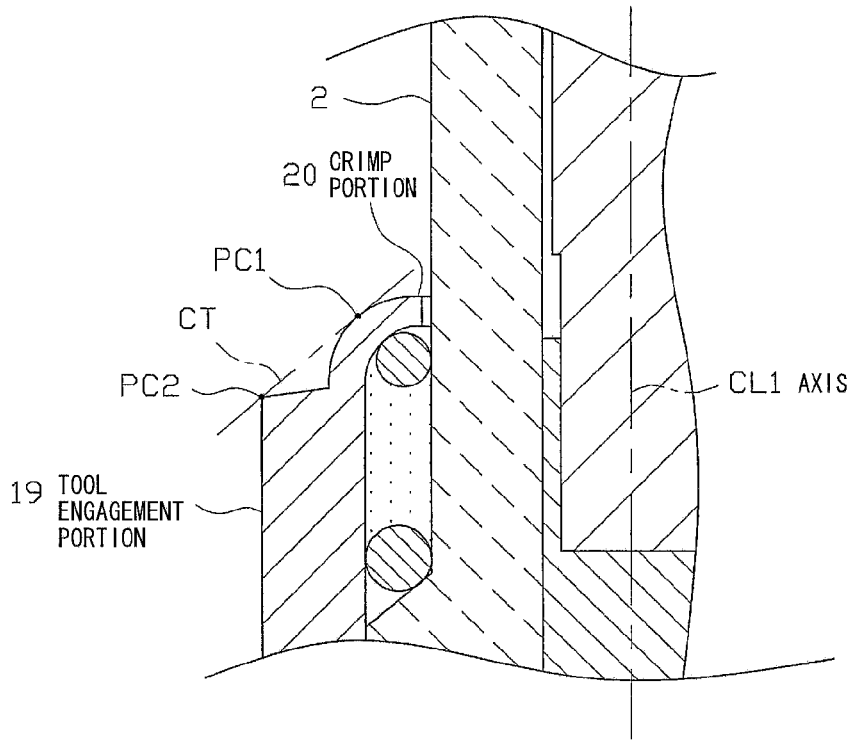
FIG. 4 is an enlarged schematic sectional view for explaining the proximal end of a crimp portion.

Further, in the present embodiment, when C (mm) represents the outside diameter of the proximal end of the crimp portion 20, the relational expression $0.70 \leq (C-B)/2 \leq 1.00$ is satisfied. The "proximal end of the crimp portion 20" refers to, as shown in FIG. 4, a region of the metallic shell 3 defined as follows: "as viewed on a section which contains the axis CL1, a region of the metallic shell 3 most distant from a common tangent CT tangent to the outer circumferential surface of the crimp portion 20 and to the outer circumferential surface of the tool engagement portion 19 as viewed within a range between a point of contact PC1 between the crimp portion 20 and the common tangent CT and a point of contact PC2 between the tool engagement portion 19 and the common tangent CT."

Also, in the present embodiment, the size of the tool engagement portion 19 is specified as 14 mm or less (e.g., 12 mm or less).

Furthermore, the groove portion 21 is configured such that, when H (mm) represents the length of the groove portion 21 along the axis CL1, and T (mm) represents the thickness of the groove portion 21, the relational expressions $T \geq 0.7$ and $3.0 \leq H/T \leq 5.5$ are satisfied (see FIG. 3). In the case where the thickness of the groove portion 21 varies along the axis CL1, the "thickness of the groove portion 21" means the thickness of the metallic shell 3 as measured at an intermediate portion, along the axis CL1, between the front end and the rear end of the groove portion 21.

Next, a method for producing the spark plug 1 configured as mentioned above will be described.

First, the metallic shell 3 is formed beforehand. Specifically, a circular columnar metal material of an iron-based material, such as S17C or S25C, or a stainless steel material is prepared.

Figure 5:
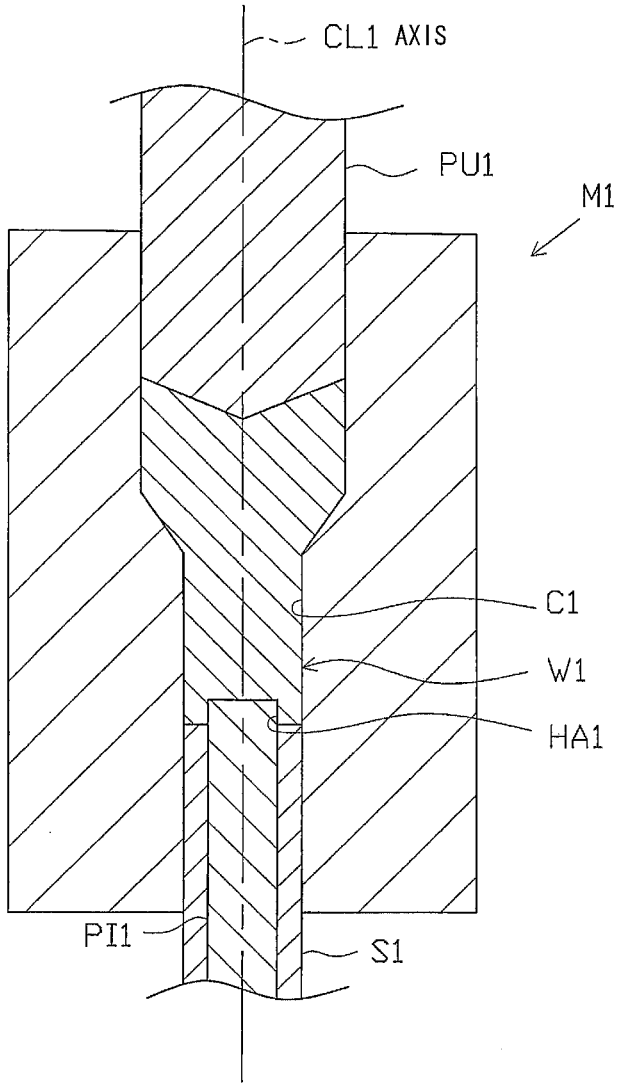
FIG. 5 is a sectional view showing a first die, etc., in a process of producing the metallic shell.

Next, by use of a first die M1, etc., shown in FIG. 5, the metal material is subjected to cold extrusion. Specifically, the first die M1 extends in the direction of the axis CL1 and has a cavity C1 whose rear portion has a large diameter and whose front portion has a small diameter. The metal material is inserted into a large-diameter portion of the cavity C1. A tubular sleeve S1 and a pin PI1, which is inserted through the sleeve S1 in such a manner that a distal end portion thereof projects rearward from the sleeve S1 into the cavity C1, are disposed in the front portion of the cavity C1. In this condition, a punch PU1 whose outside diameter is substantially equal to the diameter of the large-diameter portion of the cavity C1 is inserted from the rear side of the cavity C1, thereby extruding the metal material frontward along the direction of the axis CL1. This procedure yields a first workpiece W1 whose front portion has a small diameter and whose front end portion has a hole HA1.

Figure 6:
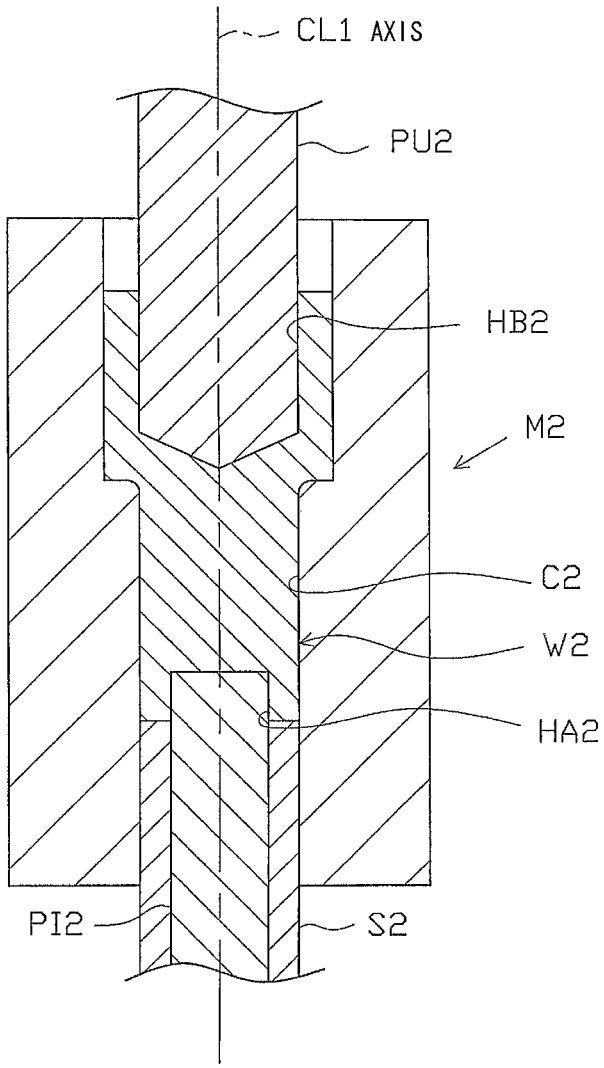
FIG. 6 is a sectional view showing a second die, etc., in the process of producing the metallic shell.

Next, by use of a second die M2 shown in FIG. 6, the first workpiece W1 is subjected to cold extrusion. Specifically, the second die M2 has a cavity C2 whose rear portion has a large diameter and whose front portion has a small diameter. The first workpiece W1 is inserted into the cavity C2 from the rear side. A tubular sleeve S2 and a pin PI2, which is inserted through the sleeve S2 in such a manner that a distal end portion thereof projects rearward from the sleeve S2 into the cavity C2, are disposed in the front portion of the cavity C2. In this condition, a punch PU2 whose outside diameter is smaller than the inside diameter of the large-diameter portion of the cavity C2 is inserted from the rear side of the cavity C2. By this procedure, the first workpiece W1 is extruded, thereby yielding a second workpiece W2 whose front portion has a hole HA2 and whose rear portion has a hole HB2.

Figure 7:
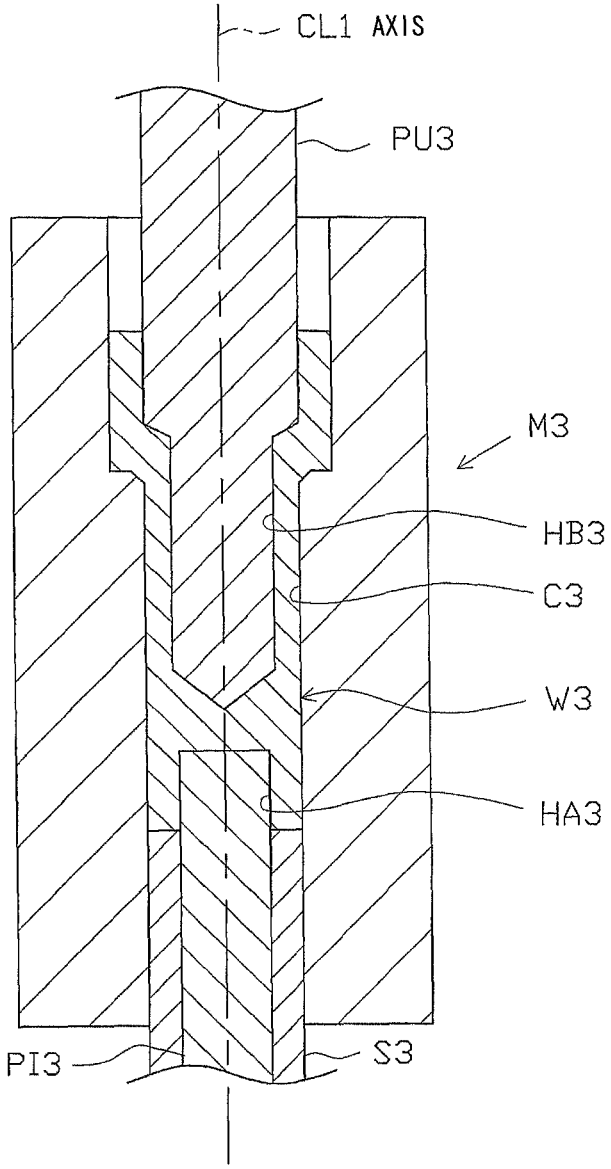
FIG. 7 is a sectional view showing a third die, etc., in the process of producing the metallic shell.

Next, by use of a third die M3 shown in FIG. 7, the second workpiece W2 is subjected to cold extrusion. Specifically, the third die M3 has a cavity C3 whose rear portion has a large diameter and whose front portion has a small diameter. The second workpiece W2 is inserted into the cavity C3 from the rear side. A sleeve S3 and a pin PI3, whose distal end portion projects rearward from the sleeve S3, are disposed in the front portion of the cavity C3. In this condition, a punch PU3 whose outside diameter is smaller than the inside diameter of the large-diameter portion of the cavity C3 and which has a step on its outer circumference is inserted from the rear side of the cavity C3. By this procedure, the second workpiece W2 is extruded, thereby yielding a third workpiece W3 whose front portion has a hole HA3 and whose rear portion has a hole HB3.

Figure 8:
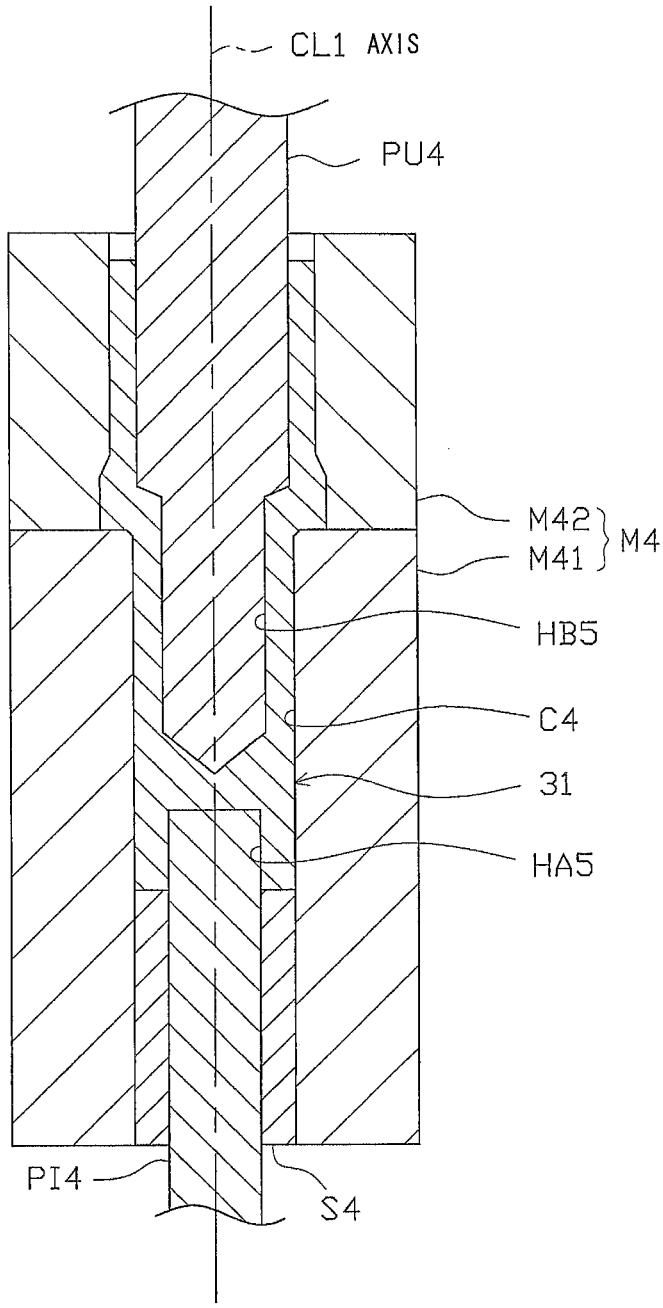
FIG. 8 is a sectional view showing a fourth die, etc., in the process of producing the metallic shell.
Figure 9:
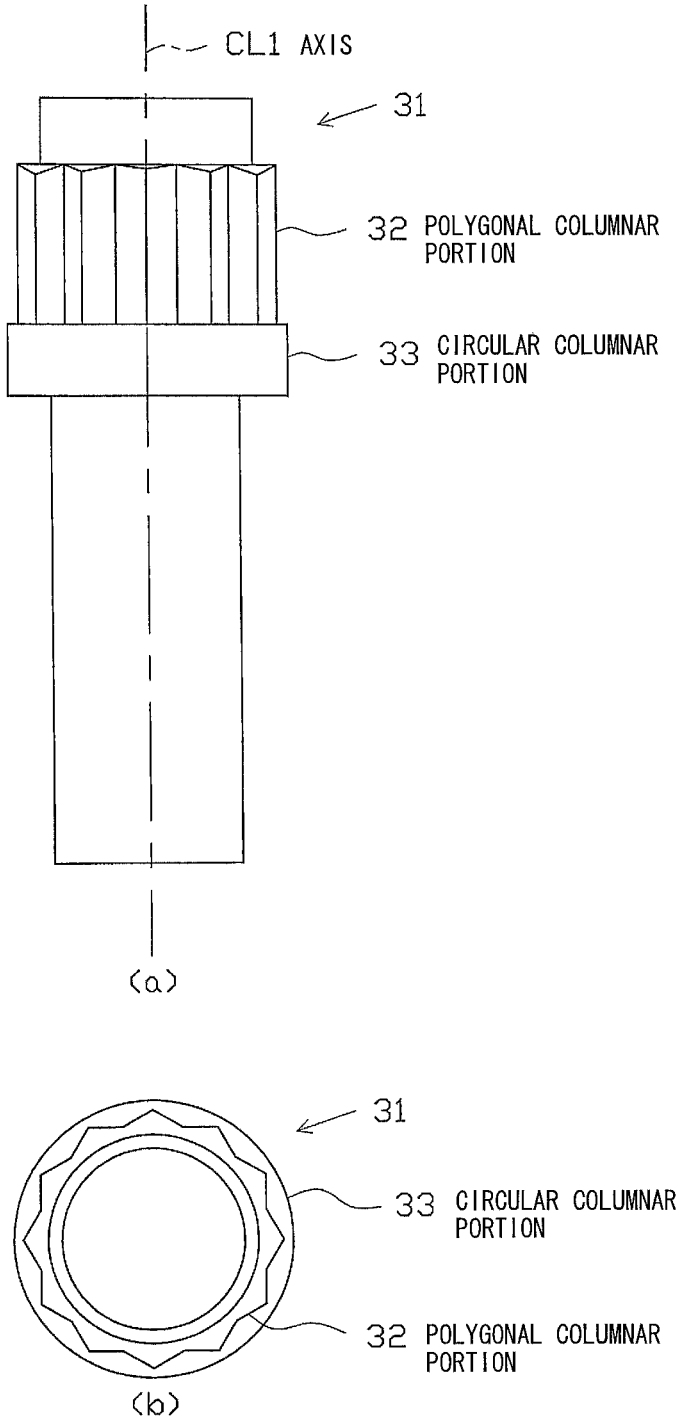
FIG. 9 contains views showing the configuration of a metallic-shell intermediate, wherein (a) is a front view, and (b) is a plan view.

Next, by use of a fourth die M4 shown in FIG. 8, the third workpiece W3 is subjected to cold extrusion. Specifically, the fourth die M4 is configured such that a tubular front-side die M41 and a tubular rear-side die M42 are coaxially united together, and has a cavity C4 extending in the direction of the axis CL1. The inner circumferential portion of the rear-side die M42 is formed such that its front side has a large diameter, whereas its back side has a small diameter. The inner circumferential surface of the large-diameter portion has a cylindrical shape corresponding to the shape of the large-diameter portion 16. On the other hand, at least the front side of the inner circumferential surface of the small-diameter portion has a shape corresponding to the 12-point shape of the tool engagement portion 19; i.e., recesses corresponding to the protrusions 19A, and protrusions corresponding to the recesses 19B. Now back to the description of the producing method, the third workpiece W3 is inserted into the cavity C4 from the rear side. A sleeve S4 and a pin PI4, whose distal end portion projects rearward from the sleeve S4, are disposed in the front portion of the cavity C4. In this condition, a punch PU4 having a step on its outer circumference is inserted from the rear side of the cavity C4 so as to bring the outer circumferential surface of the third workpiece W3 into pressing contact with the inner circumferential surface of the fourth die M4. This procedure yields, as shown in FIG. 9, a metallic-shell intermediate 31 which has a polygonal columnar portion 32 having the same sectional shape as that of the tool engagement portion 19, and a circular columnar portion 33 connected to the front end of the polygonal columnar portion 32 and having the same sectional shape as that of the large-diameter portion 16. The metallic-shell intermediate 31 has a hole HA5 formed in its front portion, and a hole HB5 formed in its rear portion (see FIG. 8).

Figure 10:
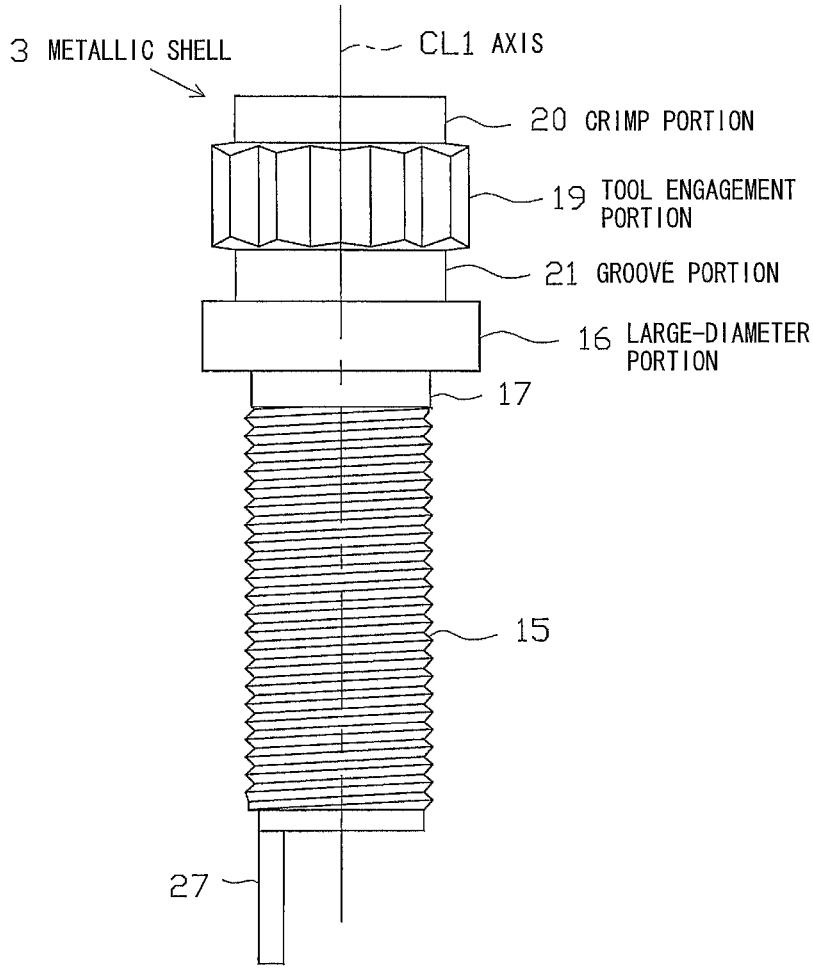
FIG. 10 is a front view showing the configuration of the metallic shell, etc.

Subsequently, the metallic-shell intermediate 31 is penetrated between the hole HA5 and the hole HB5 by use of a punch or the like. Furthermore, a front end portion of the polygonal columnar portion 32 is subjected to machining or the like, whereby, as shown in FIG. 10, the cylindrical groove portion 21 is formed between the large-diameter portion 16 and the tool engagement portion 19; the polygonal columnar portion 32 is formed into the tool engagement portion 19; and the circular columnar portion 33 is formed into the large-diameter portion 16.

Subsequently, the ground electrode 27 having the form of a straight rod is resistance-welded to the front end surface of the metallic-shell intermediate 31. The resistance welding is accompanied by formation of so-called "sags." After the "sags" are removed, the threaded portion 15 is formed in a predetermined region of the metallic-shell intermediate 31 by rolling. Thus is yielded the metallic shell 3 to which the ground electrode 27 is welded. The metallic shell 3 to which the ground electrode 27 is welded is subjected to zinc plating or nickel plating. In order to enhance corrosion resistance, the plated surface may be further subjected to chromate treatment.

Separately from preparation of the metallic shell 3, the ceramic insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping. The shaped green compact is subjected to firing, thereby yielding the ceramic insulator 2.

Separately from preparation of the metallic shell 3 and the ceramic insulator 2, the center electrode 5 is formed. Specifically, an Ni alloy is subjected to forging, machining, etc., thereby forming the center electrode 5.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial bore 4 of the ceramic insulator 2 such that the resistor 7 is sandwiched therebetween. Subsequently, the resultant assembly is sintered, in a kiln, in a condition in which the charged mixture is pressed from the rear by the terminal electrode 6. At this time, a glaze layer may be simultaneously fired on the surface of the rear trunk portion 10 of the ceramic insulator 2; alternatively, the glaze layer may be formed beforehand.

Subsequently, the thus-formed ceramic insulator 2 having the center electrode 5 and the terminal electrode 6, and the thus-formed metallic shell 3 having the ground electrode 27 are assembled together. More specifically, a relatively thin-walled rear-end opening portion of the metallic shell 3 is crimped radially inward; i.e., the crimp portion 20 is formed, thereby fixing the ceramic insulator 2 and the metallic shell 3 together. The crimping process causes the groove portion 21 to be curved radially outward.

Finally, a substantially intermediate portion of the ground electrode 27 is bent, thereby adjusting the magnitude of the spark discharge gap 28. The spark plug 1 is thus yielded.

As described in detail above, according to the present embodiment, the tool engagement portion 19 is formed in such a manner that the diameter D (mm) of the circumscribed circle CC of the tool engagement portion 19 and the diameter d (mm) of the inscribed circle IC of the tool engagement portion 19 satisfy the relational expression $0.45 \leq (D-d)/2 \leq 0.75$. That is, through employment of a sufficiently large value of $(D-d)/2$ of 0.45 mm or greater, a relatively large difference in diameter is established between the circumscribed circle CC and the inscribed circle IC of the tool engagement portion 19, whereby sufficient strength of engagement of a tool with the tool engagement portion 19 can be ensured. As a result, when the spark plug 1 is to be mounted, slippage of the tool on the tool engagement portion 19 can be more reliably prevented.

Also, through employment of a value of $(D-d)/2$ of 0.75 mm or less, in the course of extrusion, the material of the third workpiece W3 can reliably reach deep into the recesses of the rear-side die M42 corresponding to the protrusions 19A of the tool engagement portion 19. As a result, the tool engagement portion 19 can be more reliably formed in a desired shape.

Furthermore, the employment of a value of $(D-d)/2$ of 0.75 mm or less can prevent the angle of the recesses of the rear-side die M42 from becoming excessively small (steep), whereby, in the course of extrusion, application of an excessive stress to the rear-side die M42 from the third workpiece W3 can be more reliably restrained. As a result, the service life of the rear-side die M42 can be elongated, and productivity can be further improved.

Additionally, according to the present embodiment, the difference between the outside diameter A (mm) of the large-diameter portion 16 of the metallic shell 3 and the diameter D (mm) of the circumscribed circle CC of the tool engagement portion 19 is determined such that the outside diameter A (mm) and the diameter D (mm) satisfy the relational expression $0.60 \leq (A-D)/2 \leq 1.00$. Thus, a shortage of material in the protrusions 19A of the tool engagement portion 19 and a deformation of the large-diameter portion 16 can be more reliably prevented, so that the tool engagement portion 19 and the large-diameter portion 16 can be more reliably formed in respectively desired shapes.

Also, the difference between the inside diameter B (mm) of the metallic shell 3 as measured at a position corresponding to the tool engagement portion 19 and the diameter d (mm) of the inscribed circle IC of the tool engagement portion 19 is determined such that the inside diameter B (mm) and the diameter d satisfy the relational expression $1.30 \leq (d-B)/2 \leq 1.40$. That is, through employment of a value of $(d-B)/2$ of 1.30 mm or greater, the tool engagement portion 19 can have a sufficient wall thickness. Thus, in a crimping process, in which a large load is imposed on the tool engagement portion 19, the occurrence of cracking in or a deformation of the tool engagement portion 19 can be more reliably prevented.

Furthermore, the employment of a value of $(d-B)/2$ of 1.40 mm or less can more reliably prevent dimensional variation of the tool engagement portion 19 and the large-diameter portion 16 among products. As a result, productivity can be further improved.

Further, the inside diameter B (mm) of the metallic shell 3 and the outside diameter C (mm) of the proximal end of the crimp portion 20 are determined so as to satisfy the relational expression $0.70 \leq (C-B)/2 \leq 1.00$. That is, through employment of a value of $(C-B)/2$ of 0.70 mm or greater, the crimp portion 20 can have a sufficient wall thickness. Thus, an axial force which the crimp portion 20 applies to the ceramic insulator 2 can be further increased, thereby further improving fixation between the metallic shell 3 and the ceramic insulator 2. Also, there can be effectively prevented a reverse deformation of the crimp portion 20 which could otherwise result from impact associated with operation of a combustion apparatus, or the like. This also contributes to improvement in fixation between the metallic shell 3 and the ceramic insulator 2.

On the other hand, the value of $(C-B)/2$ is specified as 1.00 mm or less, thereby preventing the crimp portion 20 from becoming excessively thick. This can more reliably prevent a situation in which, in the course of crimping, the tool engagement portion 19 is also deformed in association with a deformation of the crimp portion 20.

Additionally, the thickness T (mm) of the groove portion 21 and the length H (mm) of the groove portion 21 are determined so as to satisfy the relational expressions $T \geq 0.7$ and $3.0 \leq H/T \leq 5.5$. This prevents a deformation of the tool engagement portion 19 in the course of crimping, whereby the tool engagement portion 19 can be formed more reliably in such a manner as to assume a desired shape. Also, an axial force which the metallic shell 3 applies to the ceramic insulator 2 can be sufficiently large, whereby excellent gastightness can be established between the ceramic insulator 2 and the metallic shell 3.

Next, in order to verify actions and effects to be yielded by the above embodiment, an engaging-property evaluation test and a workability evaluation test were conducted.

Figure 11:
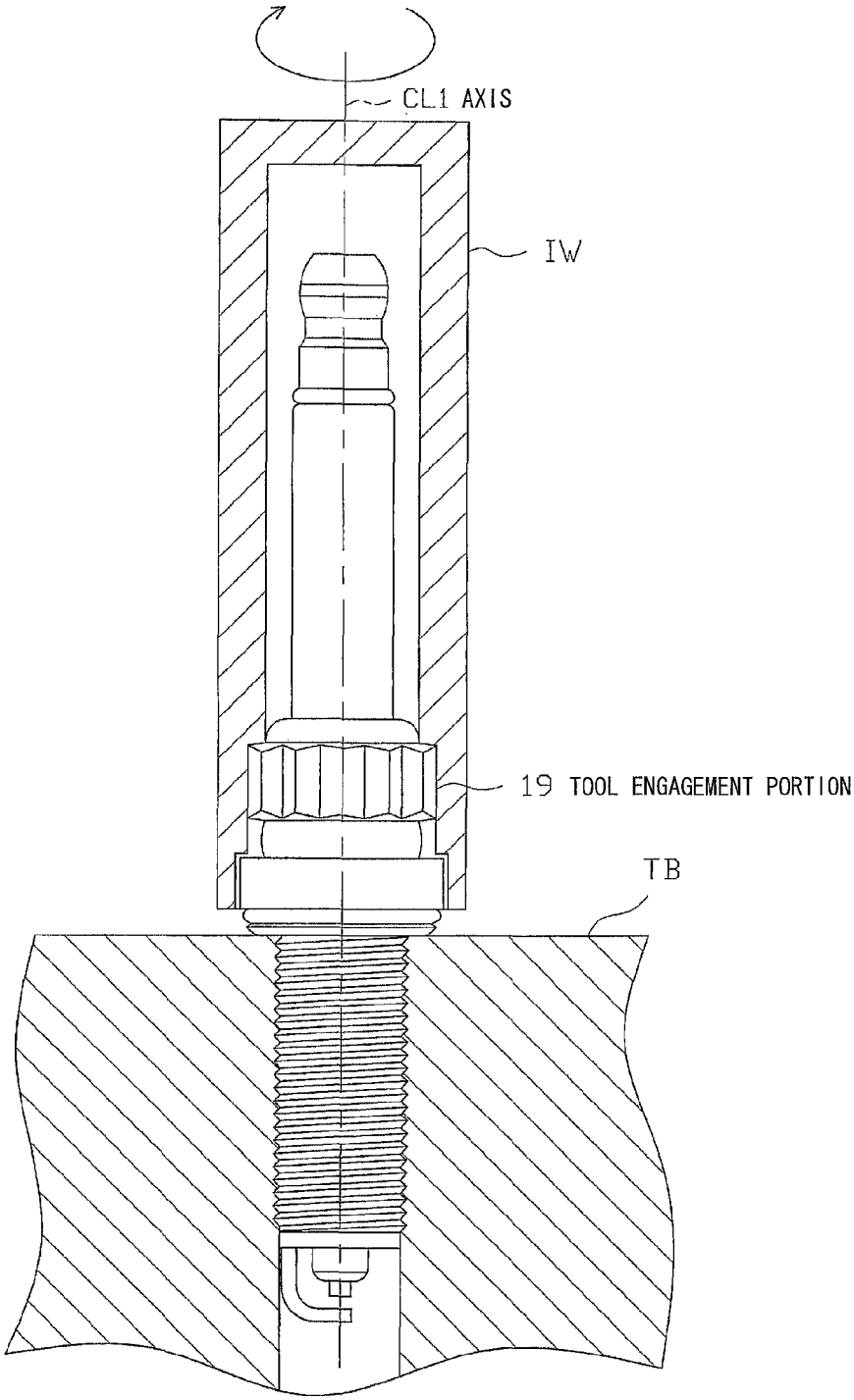
FIG. 11 is a partially sectional front view showing the configuration of an impact wrench, etc., for explaining a test method for an engaging-property evaluation test.

The outline of the engaging-property evaluation test is as follows. There were fabricated spark plug samples which differed, as viewed on a section orthogonal to the axis, in the diameter D (mm) of a circumscribed circle of the tool engagement portion and in the diameter d (mm) of an inscribed circle of the tool engagement portion. As shown in FIG. 11, each of the samples was tightened to a test bed TB made of iron by use of an impact wrench IW and checked to see if slippage occurred between the impact wrench IW and the tool engagement portion 19 in the course of tightening. The samples which suffered slippage between the impact wrench IW and the tool engagement portion 19 were evaluated as "Poor," indicating that the strength of engagement is insufficient. The samples which were free from slippage between the impact wrench IW and the tool engagement portion 19 were evaluated as "Good," indicating that the strength of engagement is excellent. The samples were tightened for five seconds with a rotational speed of the impact wrench IW of 6,000 rpm.

The outline of the workability evaluation test is as follows. There were prepared a plurality of rear-side dies which differed in an inner circumferential shape (particularly, a region of the shape adapted to form the polygonal columnar portion) so as to vary the diameter D and the diameter d. Each of the rear-side dies was used a plurality of times for forming the metallic-shell intermediates from the third workpieces through cold extrusion. When the polygonal columnar portion (tool engagement portion) of the metallic-shell intermediate failed to assume a desired shape or when the rear-side die was broken at a relatively early stage, an evaluation of "Poor" was made, indicating workability is poor. By contrast, when the polygonal columnar portion (tool engagement portion) was able to be formed in a desired shape, and the rear-side die was free from breakage even after execution of a large number of extrusions, an evaluation of "Good" was made, indicating that workability is excellent. Furthermore, when the polygonal columnar portion (tool engagement portion) was able to be formed in a desired shape, and the rear-side die was far less likely to break, an evaluation of "Excellent" was made, indicating that workability is quite excellent.

Table 1 shows the results of the engaging-property evaluation test and the results of the workability evaluation test for various values of the diameter D and the diameter d. The size of the tool engagement portion (polygonal columnar portions) was 12 mm or 14 mm. The engaging-property evaluation test was conducted when the result of evaluation of the workability evaluation test was "Good" or "Excellent."

TABLE 1

| Size of tool engagement portion | D (mm) | d (mm) | (D − d)/2 (mm) | Evaluation of engaging property | Evaluation of workability |
|---|---|---|---|---|---|
| 12 mm | 13.30 | 12.55 | 0.38 | Poor | Excellent |
| 12 mm | 13.30 | 12.50 | 0.40 | Poor | Excellent |
| 12 mm | 13.50 | 12.70 | 0.40 | Poor | Excellent |
| 12 mm | 13.30 | 12.40 | 0.45 | Good | Excellent |
| 12 mm | 13.30 | 12.30 | 0.50 | Good | Excellent |
| 12 mm | 13.50 | 12.30 | 0.60 | Good | Excellent |
| 12 mm | 13.80 | 12.50 | 0.65 | Good | Excellent |
| 12 mm | 13.80 | 12.30 | 0.75 | Good | Good |
| 12 mm | 13.80 | 12.25 | 0.78 | — | Poor |
| 12 mm | 13.85 | 12.25 | 0.80 | — | Poor |
| 14 mm | 15.50 | 14.70 | 0.40 | Poor | Excellent |
| 14 mm | 15.50 | 14.60 | 0.45 | Good | Excellent |
| 14 mm | 15.80 | 14.30 | 0.75 | Good | Excellent |
| 14 mm | 16.00 | 14.30 | 0.85 | — | Poor |

As shown in Table 1, the samples having a value of (D−d)/2 of less than 0.45 mm suffer slippage between the impact wrench IW and the tool engagement portion, indicating that the strength of engagement becomes insufficient.

Also, in the case of use of the rear-side die whose inner circumferential shape is formed in such a manner that the value of (D−d)/2 exceeds 0.75 mm, workability has been found to deteriorate. Conceivably, this is for the following reasons. In order to increase the value of (D−d), recesses formed in the inner circumferential portion of the rear-side die so as to correspond to the protrusions of the tool engagement portion must be reduced in angle. As a result of the recesses being reduced in angle, even when the third workpiece was extruded toward the inner circumferential surface of the rear-side die, the material of the third workpiece failed to reach deep into the recesses. Also, even though the material of the third workpiece was able to reach deep into the recesses, the third workpiece applied an excessive stress to the rear-side die.

By contrast, the samples having a value of (D−d)/2 of 0.45 mm to 0.75 mm inclusive have been found to be excellent in engaging property and workability. Conceivably, this is for the following reasons. The employment of a sufficiently large value of (D−d)/2 of 0.45 mm or greater ensured sufficient strength of engagement of a tool, such as a wrench, with the tool engagement portion. At the same time, the employment of a value of (D−d)/2 of 0.75 mm or less enabled the material of the third workpiece to relatively easily reach deep into the recesses of the rear-side die and effectively restrained application of an excessively large stress to the rear-side die from the third workpiece.

Particularly, the following has been confirmed: the samples having a value of (D−d)/2 of 0.45 mm to 0.65 mm inclusive are excellent in engaging property, and the employment of a value of (D−d)/2 of 0.45 mm to 0.65 mm inclusive more reliably prevents breakage of the rear-side die and enables quite excellent workability.

On the basis of the above test results, in order to improve both of the engaging property and workability of the tool engagement portion, preferably, the diameter D (mm) of a circumscribed circle of the tool engagement portion and the diameter d (mm) of an inscribed circle of the tool engagement portion are determined so as to satisfy the relational expression $0.45 \leq (D-d)/2 \leq 0.75$. Also, in view of further improvement in workability, more preferably, the relational expression $0.45 \leq (D-d)/2 \leq 0.65$ is satisfied.

Next, there were prepared a plurality of rear-side dies which differed in an inner circumferential shape (particularly, a region of the shape adapted to form the circular columnar portion and the polygonal columnar portion) so as to vary the diameter A (mm) of the large-diameter portion and the diameter D (mm) of a circumscribed circle of the tool engagement portion. By use of the rear-side dies, a formability evaluation test was conducted. The formability evaluation test was conducted as follows: each of the rear-side dies was used a plurality of times for forming the metallic-shell intermediates from the third workpieces through cold extrusion. In the test, when the circular columnar portion and the polygonal columnar portion were formed in respectively desired shapes, an evaluation of "Good" was made, indicating that formability is excellent. When the circular columnar portion or the polygonal columnar portion failed to assume a desired shape (i.e., when distortions extending from the protrusions of the polygonal columnar portion emerged on the outer circumferential surface of the circular columnar portion, or the protrusions of the polygonal columnar portion failed to assume a desired shape), an evaluation of "Poor" was made, indicating that formability is poor. Table 2 shows the values of the diameters A and D, etc., and the results of the formability evaluation test. The size of the tool engagement portion was 12 mm or 14 mm.

TABLE 2

| Size of tool engagement portion | A (mm) | D (mm) | (A − D)/2 (mm) | Evaluation of formability |
|---|---|---|---|---|
| 12 mm | 14.30 | 13.30 | 0.50 | Poor |
| 12 mm | 14.50 | 13.30 | 0.60 | Good |
| 12 mm | 15.00 | 13.30 | 0.85 | Good |
| 12 mm | 15.30 | 13.30 | 1.00 | Good |
| 12 mm | 15.50 | 13.30 | 1.10 | Poor |
| 14 mm | 16.50 | 15.50 | 0.50 | Poor |
| 14 mm | 16.70 | 15.50 | 0.60 | Good |
| 14 mm | 17.00 | 15.50 | 0.75 | Good |
| 14 mm | 17.50 | 15.50 | 1.00 | Good |
| 14 mm | 17.70 | 15.50 | 1.10 | Poor |

As is apparent from Table 2, in the case of use of the rear-side die whose inner circumferential shape is formed in such a manner that the value of (A−D)/2 is less than 0.60 mm, distortions extending from the protrusions of the polygonal columnar portion emerge on the outer circumferential surface of the circular columnar portion, indicating that formability is poor. Conceivably, this is for the following reason: since the difference between the diameter of the polygonal columnar portion (the diameter of a circumscribed circle of the tool engagement portion) and the diameter of the circular columnar portion is excessively small, in the course of formation of the circular columnar portion, the outer circumferential shape of the polygonal columnar portion is apt to emerge at an outer circumferential surface of the circular columnar portion.

Also, in the case of use of the rear-side die whose inner circumferential shape is formed in such a manner that the value of (A−D)/2 is in excess of 1.00 mm, the following has been found: the protrusions of the polygonal columnar portion fails to assume a desired shape, indicating that formability is poor. Conceivably, this is for the following reason: since the diameter of the circular columnar portion is excessively large relative to the diameter of the polygonal columnar portion (the diameter of a circumscribed circle of the tool engagement portion), more material must be moved to a region of the rear-side die corresponding to the circular columnar portion; as a result, material is less likely to move to a region of the rear-side die corresponding to the polygonal columnar portion.

By contrast, in the case of use of the rear-side die whose inner circumferential shape is formed in such a manner that the value of (A−D)/2 is 0.60 mm to 1.00 mm inclusive, the following has been confirmed: the polygonal columnar portion and the circular columnar portion can be formed in respectively desired shapes, indicating that formability is excellent. Thus, in order to enhance formability of the metallic shell in the course of extrusion, preferably, the diameter A of the large-diameter portion and the diameter D of a circumscribed circle of the tool engagement portion are determined so as to satisfy the relational expression $0.60 \leq (A-D) \leq 1.00$.

Next, there were fabricated metallic shell samples which, as viewed on a section orthogonal to the axis, differed in the diameter d (mm) of an inscribed circle of the tool engagement portion and in the inside diameter B (mm) of the metallic shell as measured at a position corresponding to the tool engagement portion. The samples were subjected to a strength evaluation test. In the strength evaluation test, the metallic shell samples and ceramic insulators are fixed together through crimping to check to see if the tool engagement portions suffer cracking or deformation. The samples which suffered cracking in or a deformation of the tool engagement portions were evaluated as "Poor," indicating that the tool engagement portions are insufficient in strength. The samples which were free from cracking in or a deformation of the tool engagement portions were evaluated as "Good," indicating that the tool engagement portions have sufficient strength.

Furthermore, there were prepared a plurality of rear-side dies which differed in an inner circumferential shape (particularly, a region of the shape adapted to form the polygonal columnar portion and the circular columnar portion) so as to vary the diameter d and the diameter B. By use of the rear-side dies, the above-mentioned formability evaluation test was conducted. When the circular columnar portion and the polygonal columnar portion were formed in respectively desired shapes, an evaluation of "Good" was made, indicating that formability is excellent. When the circular columnar portions and the polygonal columnar portions of the metallic-shell intermediates were formed in substantially desired shapes, respectively, but the circular columnar portions or the polygonal columnar portions varied somewhat in dimension among a plurality of the fabricated metallic-shell intermediates, an evaluation of "Fair" was made, indicating that formability is a little poor.

Table 3 shows the values of the diameter d of an inscribed circle of the tool engagement portion and the inside diameter B of the metallic shell, and the results of the strength evaluation test and the formability evaluation test. The size of the tool engagement portion was 12 mm.

TABLE 3

| Size of tool engagement portion | d (mm) | B (mm) | (d − B)/2 (mm) | Evaluation of strength | Evaluation of formability |
|---|---|---|---|---|---|
| 12 mm | 12.30 | 9.80 | 1.25 | Poor | Good |
| 12 mm | 12.30 | 9.70 | 1.30 | Good | Good |
| 12 mm | 12.30 | 9.50 | 1.40 | Good | Good |
| 12 mm | 12.30 | 9.40 | 1.45 | Good | Fair |

As is apparent from Table 3, in the course of crimping, the metallic shell samples having a value of (d−B)/2 of less than 1.30 mm suffer cracking in or a deformation of the tool engagement portion. A conceivable cause for this is that the wall thickness of the tool engagement portion became excessively thin. In the case of use of the rear-side die whose inner circumferential shape is formed in such a manner that the value of (d−B)/2 is in excess of 1.40 mm, the following has been found: the polygonal columnar portions and the circular columnar portions vary somewhat in dimension, indicating that formability is a little poor.

By contrast, in the case where the value of (d−B)/2 is 1.30 mm to less than 1.40 mm, it has been revealed that the tool engagement portions have sufficient strength and that dimensional variations can be effectively restrained. Thus, in view of improvement of formability while sufficient strength is imparted to the tool engagement portion, preferably, the diameter d of an inscribed circle of the tool engagement portion and the inside diameter B of the metallic shell satisfy the relational expression $1.30 \leq (d-B)/2 \leq 1.40$.

Next, there were fabricated spark plug samples which differed in the inside diameter B (mm) of the metallic shell as measured at a position corresponding to the tool engagement portion and in the outside diameter C (mm) of the proximal end of the crimp portion. The samples were subjected to an impact-resistance evaluation test. In the impact-resistance evaluation test, the impact resistance test specified in JIS B8061 is conducted for 60 minutes, and then the crimp portion of the metallic shell is checked for looseness. The samples which suffered looseness of the crimp portions were evaluated as "Poor," indicating that impact resistance is insufficient. The samples which were free from looseness of the crimp portions were evaluated as "Good," indicating that impact resistance is excellent.

Furthermore, there were fabricated metallic shell samples which differed in the inside diameter B of the metallic shell and in the outside diameter C of the proximal end of the crimp portion. The samples were subjected to the above-mentioned strength evaluation test to check for a deformation of the tool engagement portion. The samples whose tool engagement portions suffered deformation were evaluated as "Poor," indicating that the tool engagement portions are insufficient in strength against crimping. The samples whose tool engagement portions were free from deformation were evaluated as "Good," indicating that the tool engagement portions have sufficient strength.

Table 4 shows the results of the impact-resistance evaluation test and the strength evaluation test conducted on the samples which differed in the inside diameter B of the metallic shell and in the outside diameter C of the proximal end of the crimp portion. The size of the tool engagement portion was 12 mm or 14 mm. The impact-resistance test was conducted on the samples which were evaluated as "Good" in the strength evaluation test.

TABLE 4

| Size of tool engagement portion | C (mm) | B (mm) | (C − B)/2 (mm) | Evaluation of impact resistance | Evaluation of strength |
|---|---|---|---|---|---|
| 12 mm | 11.20 | 10.00 | 0.60 | Poor | Good |
| 12 mm | 11.30 | 10.00 | 0.65 | Poor | Good |
| 12 mm | 11.30 | 9.90 | 0.70 | Good | Good |
| 12 mm | 11.30 | 9.80 | 0.75 | Good | Good |
| 12 mm | 11.30 | 9.70 | 0.80 | Good | Good |
| 12 mm | 11.60 | 9.60 | 1.00 | Good | Good |
| 12 mm | 11.70 | 9.50 | 1.10 | — | Poor |
| 14 mm | 13.90 | 12.60 | 0.65 | Poor | Good |
| 14 mm | 13.90 | 12.50 | 0.70 | Good | Good |
| 14 mm | 13.90 | 12.20 | 0.85 | Good | Good |
| 14 mm | 13.90 | 12.00 | 0.95 | Good | Good |
| 14 mm | 14.00 | 12.00 | 1.00 | Good | Good |
| 14 mm | 14.00 | 11.90 | 1.05 | — | Poor |

As is apparent from Table 4, the samples having a value of (C−B)/2 in excess of 1.00 mm suffer a deformation of the tool engagement portion in the course of crimping. Conceivably, this is for the following reason: since the proximal end of the crimp portion was excessively thick, the tool engagement portion was deformed in association with a deformation of the crimp portion.

The samples having a value of (C−B)/2 less than 0.70 mm were found to suffer the loosening of the crimp portion and to potentially suffer an associated damage to fixation between the metallic shell and the ceramic insulator. A conceivable cause for this is that, since the proximal end of the crimp portion was excessively thin, the crimp portion was apt to undergo reverse deformation upon exposure to impact.

By contrast, in the case of the samples having a value of (C−B)/2 of 0.70 mm to 1.00 mm inclusive, the following has been confirmed: a deformation of the tool engagement portion can be restrained in the course of crimping, and, even upon exposure to impact, a strongly fixed condition can be maintained between the metallic shell and the ceramic insulator. Thus, in view of implementation of excellent impact resistance while a deformation of the tool engagement portion is prevented, preferably, the inside diameter B of the metallic shell and the outside diameter C of the proximal end of the crimp portion are determined so as to satisfy the relational expression $0.70 \leq (C-B)/2 \leq 1.00$.

Next, spark plug samples configured such that the ceramic insulators and the metallic shells different in the thickness T (mm) of the groove portion and in the length H (mm) of the groove portion were fixed together through crimping were evaluated for the engaging property of the tool engagement portion in engagement with a tool and were subjected to an airtightness evaluation test. The engaging property was evaluated by checking to see if a tool can be properly engaged with the tool engagement portion. When the tool was able to be properly engaged with the tool engagement portion, an evaluation of "Good" was made. When the tool failed to be properly engaged with the tool engagement portion, an evaluation of "Poor" was made. In the airtightness evaluation test, the impact resistance test (in which a sample is mounted to a predetermined testing apparatus, and impact is imposed on the sample 400 times per minute) specified in Sect. 7.4 of JIS B8031 was conducted on the samples for 30 minutes; subsequently, the airtightness test (in which a sample is allowed to stand in an atmosphere of 150° C. for 30 minutes, and then an air pressure of 1.5 MPa is applied to a front end portion of the sample) specified in Sect. 7.5 of the Standard was conducted on the samples. The samples which were free from leakage of air from between the ceramic insulator and the metallic shell were evaluated as "Good," indicating that the samples have excellent airtightness. The samples which involved leakage of air were evaluated as "Poor," indicating that the samples have poor airtightness. Table 5 shows evaluation of the engaging property and airtightness of the samples.

TABLE 5

| T (mm) | H (mm) | H/T | Evaluation of engaging property | Evaluation of airtightness |
|---|---|---|---|---|
| 0.6 | 2.3 | 3.8 | Poor | Poor |
| 0.6 | 3.0 | 5.0 | Poor | Poor |
| 0.7 | 2.3 | 3.3 | Good | Good |
| 0.7 | 2.7 | 3.9 | Good | Good |
| 0.7 | 3.5 | 5.0 | Good | Good |
| 0.8 | 2.3 | 2.9 | Poor | Good |
| 0.8 | 2.7 | 3.4 | Good | Good |
| 0.8 | 3.5 | 4.4 | Good | Good |
| 0.9 | 2.3 | 2.6 | Poor | Good |
| 0.9 | 2.7 | 3.0 | Good | Good |
| 0.9 | 3.0 | 3.3 | Good | Good |
| 0.9 | 4.2 | 4.7 | Good | Good |
| 0.9 | 4.7 | 5.2 | Good | Good |
| 0.9 | 5.0 | 5.6 | Good | Poor |
| 1.0 | 4.7 | 4.7 | Good | Good |
| 1.0 | 5.0 | 5.0 | Good | Good |
| 1.0 | 5.5 | 5.5 | Good | Good |
| 1.0 | 5.7 | 5.7 | Good | Poor |

As is apparent from Table 5, through satisfaction of the relational expression 3.0≤H/T while T is equal to or greater than 0.7 mm, the tool engagement portion allows a tool to be properly engaged therewith. Conceivably, this is for the following reason: through employment of T≥0.7, the amount of radial deformation of the groove portion was able to be rendered relatively small, and, through satisfaction of 3.0≤H/T, stress which was axially applied to the tool engagement portion from the groove portion in the course of crimping was able to be effectively reduced, whereby a deformation of the tool engagement portion was able to be restrained.

Also, it has been confirmed that the samples which satisfy the relational expressions T≥0.7 mm and H/T≤5.5 have excellent airtightness. Conceivably, this is for the following reason: while the thickness T was large to some extent, the length H was prevented from becoming excessively large relative to the thickness T, whereby an axial force which the metallic shell applied to the insulator was able to be sufficiently large.

On the basis of the above test results, in order for the tool engagement portion to allow a tool to be more reliably engaged therewith and also in order to implement excellent airtightness, preferably, the relational expressions T≥0.7 mm and 3.0≤H/T≤5.5 are satisfied.

The present invention is not limited to the above-described embodiment, but may be embodied, for example, as follows. Of course, applications and modifications other than those exemplified below are also possible.

(a) In the above embodiment, the size of the tool engagement portion 19 is 14 mm or less. However, the size of the tool engagement portion 19 is not limited thereto.

(b) The above embodiment does not specify the size (diameter) of the metallic shell 3. However, imparting the 12-point shape to the tool engagement portion as mentioned above is particularly significant for the metallic shell whose diameter is reduced. Thus, for example, the technical ideas of the present invention may be applied to the metallic shell whose threaded portion 15 has a thread diameter of M12 or less.

(c) In the above embodiment, the protrusions 19A of the tool engagement portion 19 are angular at their radially outermost positions. However, the shape at the radially outermost positions is not limited thereto. Thus, for example, at the radially outermost positions, the protrusions 19A may have a chamfered shape or a curved sectional shape (a radiused shape). In this case, the diameter D of a circumscribed circle of the tool engagement portion 19 can be reduced in a relatively easy manner. Thus, it is easier for the tool engagement portion 19 to satisfy the relational expression 0.45≤(D−d)/2≤0.75 (0.65). In order for the protrusions 19A to have a chamfered shape or a curved sectional shape at the radially outermost positions, there may be used the rear-side die whose regions of a cavity adapted to form the protrusions 19A are shaped so as to correspond to such chamfered or radiused shapes. Through use of such a rear-side die, the tool engagement portion can more reliably have a desired shape, and stress applied to the die in the course of extrusion can be reduced. As a result, productivity can be further improved.

(d) Although unmentioned in the description of the above embodiment, a noble metal tip made of a noble metal alloy (e.g., a Pt alloy or an Ir alloy) may be provided at least one of a front end portion of the center electrode 5 and a distal end portion of the ground electrode 27.

(e) According to the above embodiment, the ground electrode 27 is joined to a front end portion of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

| DESCRIPTION OF REFERENCE NUMERALS | |
|---|---|
| 1: | spark plug |
| 2: | ceramic insulator (insulator) |
| 3: | metallic shell |
| 16: | large-diameter portion |
| 19: | tool engagement portion |
| 19A: | protrusion |
| 19B: | recess |
| 20: | crimp portion |
| 21: | groove portion |
| 32: | polygonal columnar portion |
| 33: | circular columnar portion |
| CL1: | axis |

The invention claimed is:

1. A spark plug comprising:

a tubular metallic shell; and a tool engagement portion formed through extrusion in the metallic shell, wherein a cross-section of the tool engagement portion taken orthogonally to an axis of the plug has a 12-point shape containing a plurality of protrusions and recesses provided alternately, and wherein as viewed in a section of the metallic shell taken orthogonally to the axis, when D (mm) represents a diameter of a circle which passes radially through the outermost positions on the protrusions, and d (mm) represents a diameter of a circle which passes radially through the innermost positions on the recesses, a relational expression 0.45≤(D−d)/2≤0.75 is satisfied.

2. A spark plug according to claim 1, wherein the metallic shell has a large-diameter portion greater in diameter than the tool engagement portion, and when A (mm) represents an outside diameter of the large-diameter portion, a relational expression 0.60≤(A−D)/2≤1.00 is satisfied.

3. A spark plug according to claim 2, wherein the metallic shell has a groove portion located between the tool engagement portion and the large-diameter portion, and when H (mm) represents a length of the groove portion along the axis, and T (mm) represents a thickness of the groove portion, relational expressions T≥0.7 and 3.0≤H/T≤5.5 are satisfied.

4. A method for producing a spark plug according to claim 3, the metallic shell having a large-diameter portion located at a front end of the tool engagement portion that is greater in diameter than the tool engagement portion, and a groove portion located between the tool engagement portion and the large-diameter portion, the method comprising the steps of:

forming the tool engagement portion by extruding a polygonal columnar portion having the sectional shape of the tool engagement portion;

forming the large-diameter portion by extruding a circular columnar portion that is connected to a front end of the polygonal columnar portion and has the sectional shape of the large-diameter portion; and machining a front end portion of the polygonal columnar portion to form the groove portion and to complete a formation of the tool engagement portion, the large-diameter portion, and the groove portion.

5. A spark plug according to claim 1, wherein, when the metallic shell has an inside diameter B (mm) as measured at a position corresponding to the tool engagement portion, a relational expression $1.30 \leq (d-B)/2 \leq 1.40$ is satisfied.

6. A spark plug according to claim 2, wherein, when the metallic shell has an inside diameter B (mm) as measured at a position corresponding to the tool engagement portion, a relational expression $1.30 \leq (d-B)/2 \leq 1.40$ is satisfied.

7. A spark plug according to claim 1, further comprising an insulator fixed internally of an inner circumference of the metallic shell, wherein the metallic shell has a crimp portion extending rearward from a rear end of the tool engagement portion and engaged directly or indirectly with the insulator for fixing the insulator, and, when B (mm) represents an inside diameter of the metallic shell as measured at a position corresponding to the tool engagement portion, and C (mm) represents an outside diameter of a proximal end of the crimp portion, a relational expression $0.70 \leq (C-B)/2 \leq 1.00$ is satisfied.

8. A spark plug according to claim 2, further comprising an insulator fixed internally of an inner circumference of the metallic shell, wherein the metallic shell has a crimp portion extending rearward from a rear end of the tool engagement portion and engaged directly or indirectly with the insulator for fixing the insulator, and when B (mm) represents an inside diameter of the metallic shell as measured at a position corresponding to the tool engagement portion, and C (mm) represents an outside diameter of a proximal end of the crimp portion, a relational expression $0.70 \leq (C-B)/2 \leq 1.00$ is satisfied.

9. A spark plug according to claim 1, wherein a relational expression $0.45 \leq (D-d)/2 \leq 0.65$ is satisfied.

10. A spark plug according to claim 2, wherein a relational expression $0.45 \leq (D-d)/2 \leq 0.65$ is satisfied.

11. A method for producing a spark plug according to claim 2, the metallic shell having a large-diameter portion located at a front end of the tool engagement portion that is greater in diameter than the tool engagement portion, and a groove portion located between the tool engagement portion and the large-diameter portion, the method comprising the steps of:

forming the tool engagement portion by extruding a polygonal columnar portion having the sectional shape of the tool engagement portion;

forming the large-diameter portion by extruding a circular columnar portion that is connected to a front end of the polygonal columnar portion and has the sectional shape of the large-diameter portion; and machining a front end portion of the polygonal columnar portion to form the groove portion and to complete a formation of the tool engagement portion, the large-diameter portion, and the groove portion.

12. A spark plug according to claim 5, further comprising an insulator fixed internally of an inner circumference of the metallic shell, wherein the metallic shell has a crimp portion extending rearward from a rear end of the tool engagement portion and engaged directly or indirectly with the insulator for fixing the insulator, and when B (mm) represents an inside diameter of the metallic shell as measured at a position corresponding to the tool engagement portion, and C (mm) represents an outside diameter of a proximal end of the crimp portion, a relational expression $0.70 \leq (C-B)/2 \leq 1.00$ is satisfied.

13. A spark plug according to claim 5, wherein a relational expression'$0.45 \leq (D-d)/2 \leq 0.65$ is satisfied.

14. A method for producing a spark plug according to claim 5, the metallic shell having a large-diameter portion located at a front end of the tool engagement portion that is greater in diameter than the tool engagement portion, and a groove portion located between the tool engagement portion and the large-diameter portion, the method comprising the steps of:

forming the tool engagement portion by extruding a polygonal columnar portion having the sectional shape of the tool engagement portion;

forming the large-diameter portion by extruding a circular columnar portion that is connected to a front end of the polygonal columnar portion and has the sectional shape of the large-diameter portion; and machining a front end portion of the polygonal columnar portion to form the groove portion and to complete a formation of the tool engagement portion, the large-diameter portion, and the groove portion.

15. A spark plug according to claim 7, wherein a relational expression $0.45 \leq (D-d)/2 \leq 0.65$ is satisfied.

16. A method for producing a spark plug according to claim 7, the metallic shell having a large-diameter portion located at a front end of the tool engagement portion that is greater in diameter than the tool engagement portion, and a groove portion located between the tool engagement portion and the large-diameter portion, the method comprising the steps of:

forming the tool engagement portion by extruding a polygonal columnar portion having the sectional shape of the tool engagement portion;

forming the large-diameter portion by extruding a circular columnar portion that is connected to a front end of the polygonal columnar portion and has the sectional shape of the large-diameter portion; and machining a front end portion of the polygonal columnar portion to form the groove portion and to complete a formation of the tool engagement portion, the large-diameter portion, and the groove portion.

17. A method for producing a spark plug according to claim 9, the metallic shell having a large-diameter portion located at a front end of the tool engagement portion that is greater in diameter than the tool engagement portion, and a groove portion located between the tool engagement portion and the large-diameter portion, the method comprising the steps of:

forming the tool engagement portion by extruding a polygonal columnar portion having the sectional shape of the tool engagement portion;

forming the large-diameter portion by extruding a circular columnar portion that is connected to a front end of the polygonal columnar portion and has the sectional shape of the large-diameter portion; and machining a front end portion of the polygonal columnar portion to form the groove portion and to complete a formation of the tool engagement portion, the large-diameter portion, and the groove portion.

18. A method for producing a spark plug according to claim 1, the metallic shell having a large-diameter portion located at a front end of the tool engagement portion that is greater in diameter than the tool engagement portion, and a groove portion located between the tool engagement portion and the large-diameter portion, the method comprising the steps of:

forming the tool engagement portion, by extruding a polygonal columnar portion having the sectional shape of the tool engagement portion;

forming the large-diameter portion by extruding a circular columnar portion that is connected to a front end of the polygonal columnar portion and has the sectional shape of the large-diameter portion; and machining a front end portion of the polygonal columnar portion to form the groove portion and to complete a formation of the tool engagement portion, the large-diameter portion, and the groove portion.

* * * * *